US010851951B2

(12) United States Patent
Wang et al.

(10) Patent No.: US 10,851,951 B2
(45) Date of Patent: Dec. 1, 2020

(54) LED TUBE LAMP

(71) Applicant: ZHEJIANG SUPER LIGHTING ELECTRIC APPLIANCE CO., LTD, Jinyun (CN)

(72) Inventors: Mingbin Wang, Jiaxing (CN); Jian Lu, Jiaxing (CN); Aiming Xiong, Jiaxing (CN)

(73) Assignee: JIAXING SUPER LIGHTING ELECTRIC APPLIANCE CO., LTD, Jiaxing (CN)

( * ) Notice: Subject to any disclaimer, the term of this patent is extended or adjusted under 35 U.S.C. 154(b) by 0 days.

(21) Appl. No.: 16/746,849

(22) Filed: Jan. 18, 2020

(65) Prior Publication Data

US 2020/0232608 A1 Jul. 23, 2020

(30) Foreign Application Priority Data

Jan. 22, 2019 (CN) ..... 2019 1 0060472
Mar. 11, 2019 (CN) ..... 2019 1 0180555
Mar. 28, 2019 (CN) ..... 2019 1 0242868

(51) Int. Cl.

| | |
|---|---|
| ***F21K 9/272*** | (2016.01) |
| ***F21K 9/278*** | (2016.01) |
| ***F21V 23/02*** | (2006.01) |
| *F21Y 107/50* | (2016.01) |
| *F21Y 115/10* | (2016.01) |
| *F21Y 103/10* | (2016.01) |

(52) U.S. Cl.

CPC ..... *F21K 9/272* (2016.08); *F21K 9/278* (2016.08); *F21V 23/02* (2013.01); *F21Y 2103/10* (2016.08); *F21Y 2107/50* (2016.08); *F21Y 2115/10* (2016.08)

(58) Field of Classification Search

None

See application file for complete search history.

(56) References Cited

U.S. PATENT DOCUMENTS

| | | | | |
|---|---|---|---|---|
| 8,066,411 | B1 * | 11/2011 | Barton | F21K 9/27 362/310 |
| 2013/0250565 | A1 * | 9/2013 | Chiang | F21V 19/008 362/217.17 |
| 2017/0164434 | A1 * | 6/2017 | Xiong | F21V 3/061 |
| 2019/0338897 | A1 * | 11/2019 | Brown | F21K 9/275 |

* cited by examiner

*Primary Examiner* — Elmito Breval

(74) *Attorney, Agent, or Firm* — Simon Kuang Lu

(57) ABSTRACT

An LED tube lamp comprises a lamp tube, two light boards disposed in the lamp tube having a plurality of light sources mounted thereon, two lamp caps respectively disposed at both ends of the lamp tube and having a power supply disposed in the lamp caps, and a support unit. The power supply comprises a circuit board. The support unit is configured to fix the light board and comprises a main body and a support arm. The support arm is disposed on the main body and abutted to the inner surface of the lamp tube, so that the support unit can support the inner surface of the lamp tube.

15 Claims, 13 Drawing Sheets

LED TUBE LAMP

CROSS-REFERENCE TO RELATED APPLICATIONS

This application claims priority to the following Chinese Patent Applications No. CN 201910060472.9 filed on 2019 Jan. 22, CN 201910180555.1 filed on 2019 Mar. 11, CN 201910242868.5 filed on 2019 Mar. 28, the disclosures of which are incorporated herein in their entirety by reference.

BACKGROUND

Technical Field

The present disclosure relates to an LED lighting device, and more particularly, to an LED tube lamp.

Related Art

LED lighting is widely used because its benefits of far less energy consumption and longevity. The LED fluorescent lamp, commonly known as a straight tube lamp, generally comprises a lamp tube, a light board with a light source disposed in the lamp tube, lamp caps are respectively disposed at both ends of the lamp tube, and a power supply is disposed in the lamp caps. The light source and the power supply are electrically connected by the light board. The light source is comprised of a plurality of LEDs arranged on the light board, and the plurality of LEDs are sequentially arranged along the length direction of the lamp tube.

The traditional LED tube lamp comprises a lamp tube, a lamp cap, a light board, a hollow conductive pin, and power supply, wherein the lamp cap and the lamp tube are fixed; wherein the power supply is disposed in the lamp cap and electrically connected to the light board; wherein the hollow conductive pin is disposed on one end surface of the lamp cap and connected to outside of a lamp holder; wherein the light board is disposed on the inner surface of the lamp tube. There are disadvantages of the traditional LED tube lamp:

First, the light board is bonded in the lamp tube, and the lamp cap and lamp tube are fixed; wherein the positions of the light board and the hollow conductive pin are fixed; wherein the lamp cap is disposed in the lamp holder, and the direction of light emission is also fixed. If a position of the lamp holder, the lamp cap or the light board is deviated, it will affect the direction of light emission of the tube lamp.

Second, after the light board is bonded to the internal of the lamp tube, the tube lamp emits light in one direction. As a result, when applying the tube lamp in some special occasions (e.g., in an occasion which requires light emission from both sides of an advertising box), it is required to dispose two sets of tube lamps at both sides of the advertising box to achieve double-sided light emission. However, by this way, on one hand, it will raise cost; on the other hand, it will take more horizontal space.

In summary, in view of the shortcomings and defects of the existing LED tube lamp, how to design an LED tube lamp to solve a technical problem of the light emission is expected to be solved by those skilled in the art.

SUMMARY

A number of embodiments of the present disclosure are described herein in summary. However, the vocabulary expression of the present disclosure is only used to describe some embodiments (whether or not already in the claims) disclosed in this specification, rather than a complete description of all possible embodiments. Some embodiments described above as various features or aspects of the present disclosure may be combined in different ways to form an LED tube lamp or a portion thereof.

The present disclosure is directed to a new LED tube lamp and features in various aspects to solve the above problems.

The present disclosure provides an LED tube lamp, comprising a lamp tube; two light boards, disposed in the lamp tube, having a plurality of light sources mounted thereon; and two lamp caps, respectively disposed at both ends of the lamp tube and having a power supply disposed therein, the power supply comprises a circuit board;

wherein the lamp cap comprises a first member, a second member and a connecting structure; wherein the first member and the second member are connected to each other through the connecting structure; wherein the first member comprises a first side wall and an end wall; wherein a hollow conductive pin is disposed on the end wall; wherein the second member comprises a second side wall; wherein the first side wall and the second side wall are disposed coaxially, and the first side wall and the second side wall are sleeved and realize a rotatable connection through the connecting structure.

In some embodiments, the connecting structure comprises a guiding convex portion and a guiding notch; wherein one of the guiding convex portion or the guiding notch is disposed on the first member while the other is disposed on the second member; wherein the guiding convex portion and the guiding notch are disposed extendedly in the circumferential direction of the lamp cap; when the guiding convex portion and the guiding notch are integrated with each other, the guiding convex portion can rotate along the guiding notch.

In some embodiments, a plurality of slots are disposed at one end in an axial direction of the first side wall of the first member; wherein the plurality of slots are disposed in the circumferential direction of the first side wall.

In some embodiments, a slot is disposed in an inner surface of the first member; wherein the circuit board is inserted into the slot to fix.

In some embodiments, the present disclosure further comprises a support unit configured to fix the light board; wherein the support unit comprises a main body and a support arm; wherein the support arm is disposed on the main body and abutted to the inner surface of the lamp tube, so that the support unit can support the inner surface of the lamp tube.

In some embodiments, the main body comprises a first fixed portion; wherein the light board is disposed on the first fixed portion.

In some embodiments, the support unit comprises a second fixed portion; wherein two sets of the light boards are disposed thereon; wherein the two sets of the light boards are disposed respectively on the first fixed portion and the second fixed portion.

In some embodiments, the ratio of the space between the two sets of the light boards to the inner diameter of the lamp tube is between 1:2 to 1:5.

In some embodiments, the cross section of the lamp tube is divided by the two sets of the light boards as a first cross section, a second cross section and a third cross section; wherein the cross-section proportion of the first cross section and the third cross section are both larger than the proportion of the second cross section.

In some embodiments, the ratio of the cross-section proportion of the first cross section to the cross-section proportion of the second cross section is between 1.5:1 to 2.5:1.

The present disclosure further provides an LED tube lamp, comprising a lamp tube; two light boards, disposed in the lamp tube, having a plurality of light sources mounted thereon; two lamp caps, respectively disposed at both ends of the lamp tube and having a power supply disposed therein, the power supply comprises a circuit board; and a support unit; wherein a support unit is configured to fix the light board; wherein the support unit comprises a main body and a support arm; wherein the support arm is disposed on the main body and abutted to the inner surface of the lamp tube, so that the support unit can support the inner surface of the lamp tube.

In some embodiments, the main body comprises a first fixed portion; wherein the light board is disposed on the first fixed portion.

In some embodiments, the support unit comprises a second fixed portion; wherein two sets of the light boards are disposed thereon; wherein the two sets of the light boards are disposed respectively on the first fixed portion and the second fixed portion.

In some embodiments, the ratio of the space between two sets of the light boards to the inner diameter of the lamp tube is between 1:2 to 1:5.

In some embodiments, the cross section of the lamp tube is divided by the two sets light boards as a first cross section, a second cross section and a third cross section; wherein the cross-section proportion of the first cross section and the third cross section are both larger than the proportion of the second cross section.

In some embodiments, the ratio of the cross-section proportion of the first cross section to cross-section proportion of the second cross section is between 1.5:1 to 2.5:1.

In some embodiments, the lamp cap comprises a first member, a second member and a connecting structure; wherein the first member and the second member are connected to each other by the connecting structure; wherein the first member comprises a first side wall and an end wall; wherein a hollow conductive pin is disposed on the end wall; wherein the second member comprises a second side wall; wherein the first side wall and the second side wall are disposed coaxially, and the first side wall and the second side wall are sleeved. By the connecting structure, it achieves rotatable connection.

In some embodiments, the connecting structure comprises a guiding convex portion and a guiding notch; wherein one of the guiding convex portion or the guiding notch is disposed on the first member while the other is disposed on the second member; wherein the guiding convex portion and the guiding notch are disposed extendedly in the circumferential direction of the lamp cap; wherein after the guiding convex portion and the guiding notch are integrated with each other, the guiding convex portion can rotate along the guiding notch.

In some embodiments, a plurality of slots are disposed at one end in an axial direction of the first side wall of the first member; wherein the plurality of slots are disposed in the circumferential direction of the first side wall.

In some embodiments, a slot is disposed in an inner surface of the first member; wherein the circuit board is inserted into the slot to fix.

Compared to the related art, the present disclosure has a prominent and beneficial technical effect:

By the rotatable connection of the first member and the second member, the position between the first member and the lamp tube (the light board) can be adjusted. That is, when the hollow conductive pin of the first member is disposed in the lamp holder (the lamp holder is fixed), by rotating the second member, the direction of the lamp tube (the light board) can be adjusted to modify the direction of light emission of the light source. In other words, after the lamp tube is fixed (the direction of light emission is determined), if the hollow conductive pin is not aligned to the lamp holder, by rotating the first member, the hollow conductive pin is aligned to the lamp holder and complete the installation.

Utilizing the support unit to fix the light board, the structure is easy, and the craft is even easier; wherein the support unit and the lamp tube are not fixed; wherein the support unit can shift or rotate to the lamp tube; therefore, it will be easier to adjust the angle of light emission from the light board to make sure of the position of the lamp cap and the light board.

By disposing two sets of the light boards, the light emitted from both sides of the lamp tube to achieve the effect of double-sided light emission.

The ratio of the space between two sets of the light boards to the inner diameter of the lamp tube is between 1:2 to 1:5; wherein the front side of the light board (the side with the light source) and the back side of the light board are faced to an enough space to radiate the heat generated from the light source to the air in the space.

By setting the ratio of the cross-section proportion of the first cross section to cross-section proportion of the second cross section between 1.5:1 to 2.5:1, on one hand, the light source is with a greater angle of light emission; on the other hand, the heat dissipation of the light source is guaranteed.

DETAILED DESCRIPTION

In order to better understand the present disclosure, the present disclosure will be described more fully with reference to the accompanying drawings. The drawings show an embodiment of the disclosure. However, the present disclosure is implemented in many different forms and is not limited to the embodiments described below. Rather, these embodiments provide a thorough understanding of the present disclosure. The following directions such as "axial direction", "upper", "lower" and the like are for more clearly indicating the structural position relationship, and are not a limitation on the present invention. In the present invention, the "vertical", "horizontal", and "parallel" are defined as: including the case of ±10% based on the standard definition. For example, vertical usually refers to an angle of 90 degrees with respect to the reference line, but in the present invention, vertical refers to a condition including 80 degrees to 100 degrees.

Figure 1:
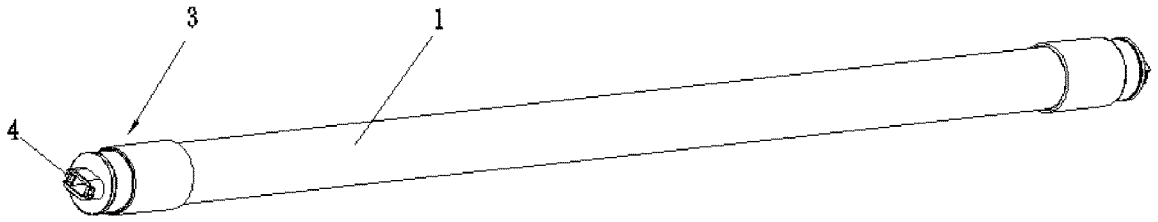
FIG. 1 illustrates a three-dimensional diagram of an LED tube lamp according to an embodiment of the instant disclosure.
Figure 2:
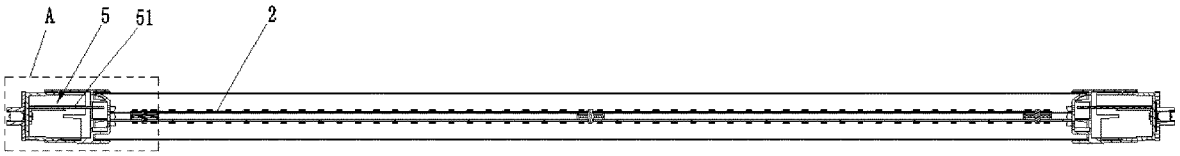
FIG. 2 illustrates a cross section diagram of an LED tube lamp according to an embodiment of the instant disclosure.

Please refer to FIG. 1 and FIG. 2, the instant disclosure provides an embodiment of an LED tube lamp comprising a lamp tube 1, a light board 2 disposed in the lamp tube 1 and two lamp caps 3 respectively disposed at both ends of the lamp tube 1, and a hollow conductive pin 4 for connecting an external power supply is disposed on the two lamp caps 3. The lamp tube 1 can be a plastic lamp tube or a glass lamp tube. The sizes of the two lamp caps 3 (the axial length dimension of the lamp cap 3) are the same or different. The instant disclosure provides an embodiment, wherein multiple light sources 21 are arranged on the light board 2. A power supply 5 is disposed in the lamp caps 3 (at least a part of the power supply 5 in a radial projection of the LED tube lamp overlaps the lamp caps 3); wherein the power supply 5 and the light source 21 are electrically connected by the light board 2. Preferably, the instant disclosure provides an embodiment, wherein the length of the power supply in the longitudinal extended direction of the lamp tube 1 is shorter than the length of the lamp cap 3, so the power supply 5 is completely accommodated in the lamp cap 3. The power supply 5 can be a single unit (for example, the power supply modules are all concentrated in one assembly and disposed in one of the lamp caps 3). Alternatively, the power supply 5 is also divided into two parts, which are called dual bodies (that is, all power supply modules are respectively configured in both assemblies); wherein both assemblies are respectively configured in the lamp cap 3 at both ends of the lamp tube 1. The instant disclosure provides an embodiment, wherein the power supply 5 comprises power supply modules including a circuit board 51, the power supply 5, and hollow conductive pin 4 connected by wire.

Figure 3:
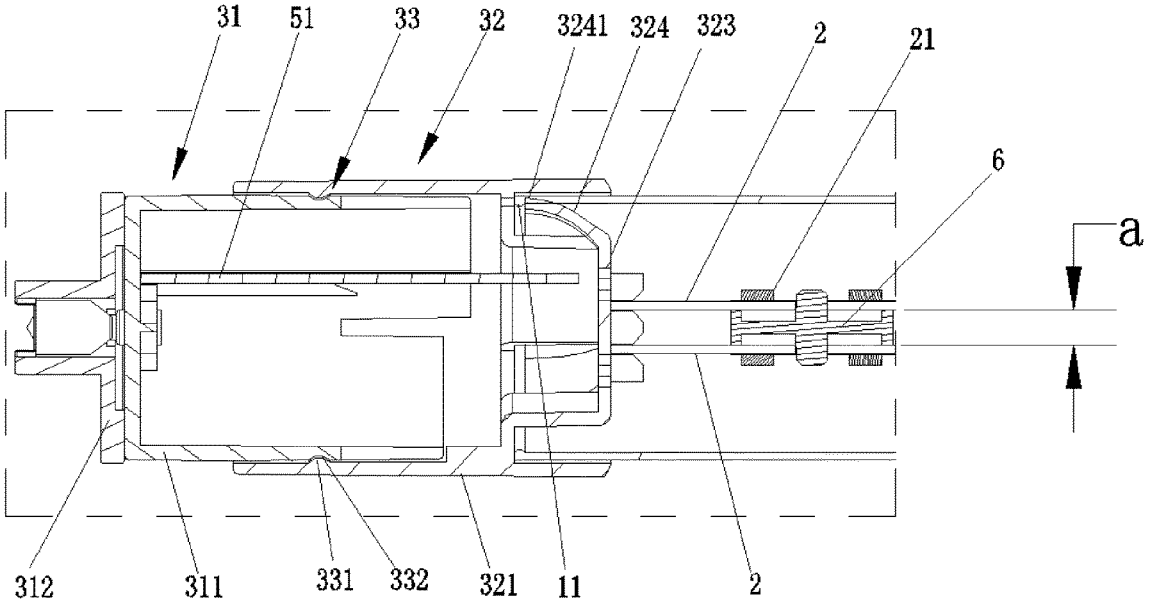
FIG. 3 illustrates a zoom-in diagram showing the structure A in FIG. 2.

Please refer to FIG. 1 to FIG. 3, the instant disclosure provides an embodiment, wherein the lamp cap 3 comprises a first member 31, a second member 32 and a connecting structure 33; wherein the first member 31 and the second member 32 are connected to each other through the connecting structure 33. The second member 32 is connected to the lamp tube 1. The first member 31 comprises a first side wall 311 and an end wall 312; wherein a hollow conductive pin 4 is disposed on the end wall 312. The second member 32 comprises a second side wall 321; wherein the first side wall 311 and the second side wall 321 are disposed coaxially; wherein the first side wall 311 and the second side wall 321 are sleeved and by the connecting structure, a rotatable connection is achieved. The connecting structure 33 comprises a guiding convex portion 331 and a guiding notch 332; wherein one of the guiding convex portion 331 or the guiding notch 332 is disposed on the first member 31 while the other is disposed on the second member 32; wherein the guiding convex portion 331 and the guiding notch 332 are disposed extendedly in the circumferential direction along the lamp cap 3; wherein when the guiding convex portion 331 and the guiding notch 332 are integrated with each other, the guiding convex portion 331 can rotate along the guiding notch 332. The instant disclosure provides an embodiment, wherein the second member 32 is sleeved outside of the first member 31; wherein the guiding convex portion 331 is disposed in the inner surface of the second side wall 321 while the guiding notch 332 is disposed on the outer surface of the first side wall 311. The instant disclosure provides an embodiment, wherein when the second member 32 is sleeved on the first member 31, and the guiding convex portion 331 is buckled into the guiding notch 332, through the connecting structure 33, the second member 32 and the first member 31 can rotate along a regular circumferential direction. The instant disclosure provides an embodiment, wherein the guiding convex portion 331 can also be disposed on the outer surface of the first side wall 311, and the guiding notch 332 can be disposed in the inner surface of the second side wall 321 to achieve the above function (not shown). The instant disclosure provides an embodiment, wherein the first member 31 and the second member 32 are rotatably connected, thus, it can adjust the position between the first member 31 and the lamp tube 1 (the light board 2). That is, when the hollow conductive pin 4 on the first member is disposed in the lamp holder (the lamp holder is fixed), by rotating the second member 32, the direction of the lamp tube 1 (the light board 2) can be adjusted to modify the direction of light emission of the light source 21. Alternatively, after the lamp tube 1 is fixed (the direction of light emission is determined), the hollow conductive pin 4 is not aligned to the lamp holder, by rotating the first member 31, and the hollow conductive pin 4 is aligned to the lamp holder to complete the installation.

Figure 4:
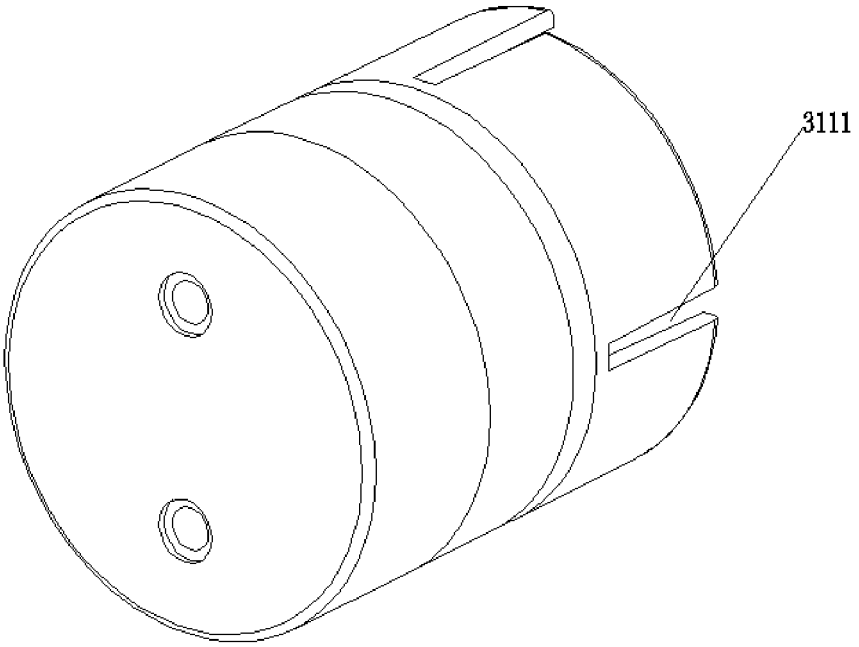
FIG. 4 illustrates a three-dimensional schematic diagram showing the first member in FIG. 1.
Figure 5:
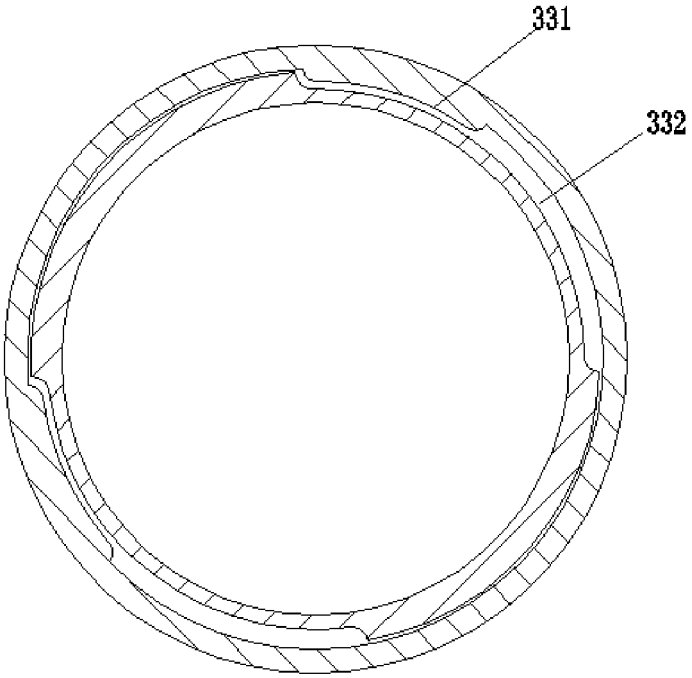
FIG. 5 illustrates schematic diagram showing the guiding notch and the guiding convex portion integrated in some embodiments.

Please refer to FIG. 4 and FIG. 5, the instant disclosure provides an embodiment, to facilitate the first member 31 inserted into the second member 32, a plurality of slots 3111 are arranged at one end of the first side wall 311 in the axial direction of the first member 31 (close to one end of the second member 32); wherein the plurality of slots 3111 are arranged in the circumferential direction along the first side wall 311, so that one end of the first side wall 311 is allocated with more space for deformation. Also, Destroying the structure solidity of one end of the first side wall 311 facilitates the first side wall 311 inserted into the second member 32, so that the guiding convex portion 331 and guiding notch 332 are integrated with each other.

In some embodiments, the first member 31 can also be sleeved outside of the second member 32 (not shown); meanwhile, one of the guiding convex portion 331 or the guiding notch 321 can be disposed on the outer surface of the second side wall 321, and the other of the guiding convex portion 331 or the guiding notch 321 is disposed on the inner surface of the first side wall 311, to achieve the rotatable function of the first member 31 and the second member 32.

The instant disclosure provides an embodiment, wherein the guiding notch 332 is annularly circled around the outer surface of the first member 31. In other words, without external limitation, after the integration of the guiding convex portion 331 and guiding notch 332, it can rotate limitlessly; that is, the angle of rotation is not limited, the relative positions of the first member 31 and the second member 32 can be adjusted. The instant disclosure provides an embodiment, wherein the guiding convex portion 331 can be in a single annular shape or multi-segmented composed of multiple parts (multiple parts on the same circumference). In some embodiments, when the guiding notch 332 extends along the circumferential direction, the guiding notch 332 is corresponded to a central angle less than 360 degrees. That is, after the guiding convex portion 331 is bucked into the guiding notch 332, the relative angle of rotation is limited by the guiding notch 332, in case when the angle of rotation is too large, the wire between the hollow conductive pin 4 and the power supply 5 or the connecting structure (e.g., wire) between the power supply 5 and the light board 2 can be ripped off. In some embodiments, a plurality (e.g., 2, 3, or 4) of the guiding notches 332 can be arranged on the circumference while a plurality of the guiding convex portions 331 can be arranged to match the corresponding guiding notches 332. Specifically, the quantity of the guiding convex portions 331 or the guiding notches 332 can be selected according to the required limited angle of rotation, as shown in FIG. 5, a schematic diagram showing the integration of two guiding convex portions arranged thereon.

Figure 6:
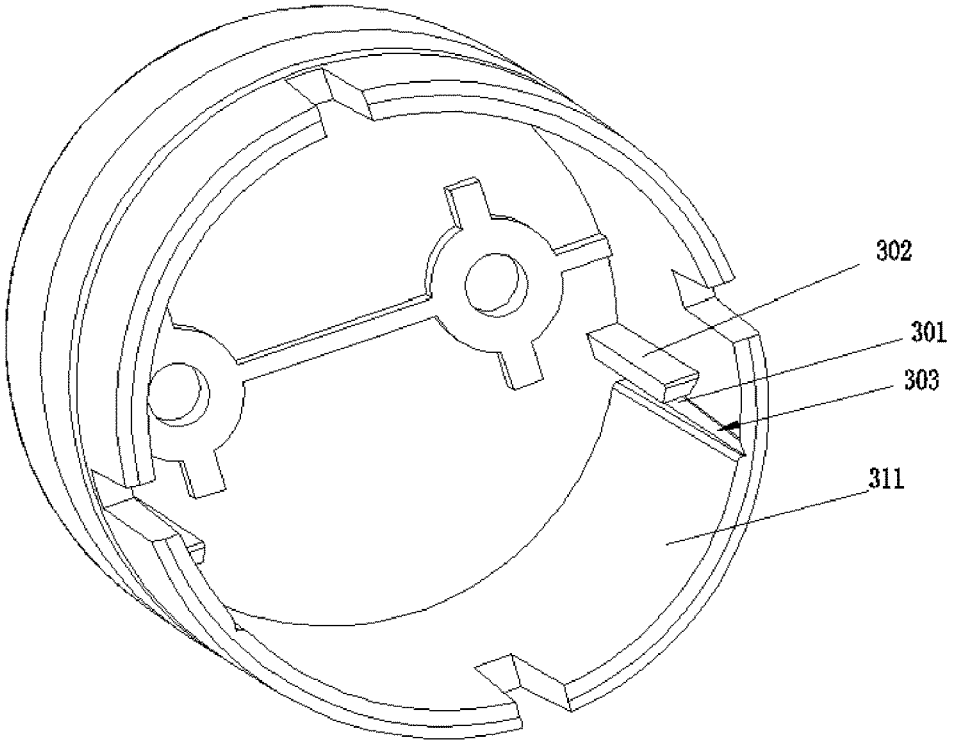
FIG. 6 illustrates a three-dimensional schematic diagram showing the first member.
Figure 7:
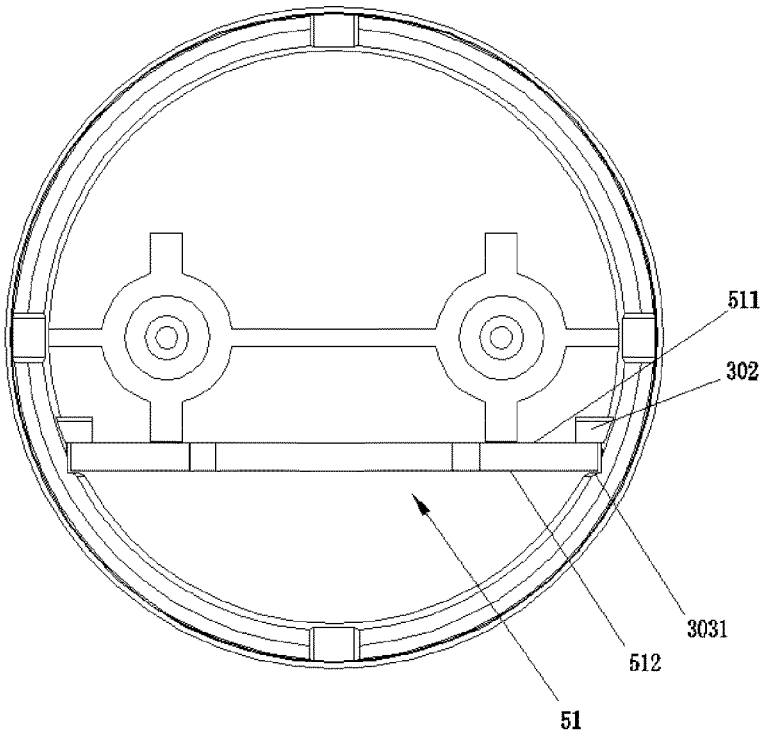
FIG. 7 illustrates schematic diagram showing the first member and the circuit board integrated.
Figure 8:
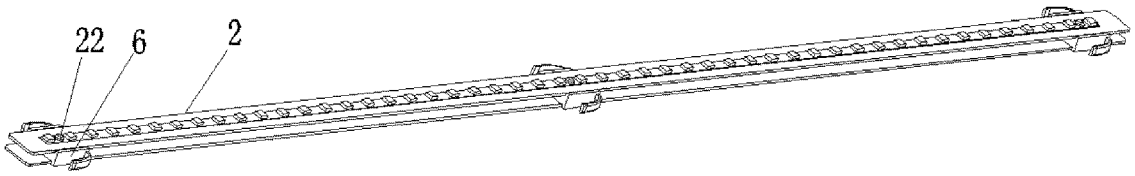
FIG. 8 illustrates schematic diagram showing the light board and the support unit integrated.

Please refer to FIG. 2, FIG. 6 and FIG. 7, the instant disclosure provides an embodiment, wherein the power supply 5 comprises a circuit board 51; wherein the circuit board 51 integrates with the one relatively closer to inner side of the radial direction of the first member 31 or the second member 32. Specifically, the instant disclosure provides an embodiment, wherein a slot 301 is disposed on the inner surface of the first member 31; wherein the circuit board 51 is inserted into the slot 301 to fix. In some embodiments, when the second member 32 is relatively closer to the inner side, the slot 301 is disposed on the inner surface of the second member 32 (not shown) to fix the circuit board 51.

The instant disclosure provides an embodiment, wherein the slot 301 comprises a first rib 302; wherein the first rib 302 in the axial direction of the lamp cap 3 can be continuously integrated or multi-segmented. The first rib 302 and the inner surface of the first side wall 311 together form the slot 301; wherein the circuit board 51 is inserted into the slot 301 to fix. Specifically, the circuit board 51 has a first surface 511 and a second surface 512 which are opposite and parallel to each other; wherein the first surface 511 and the second surface 512 are substantially parallel to the axial direction of the lamp cap 3. When the circuit board 51 is inserted into the slot 301 to fix, the first surface 511 of the circuit board 51 is corresponding to the surface of a side of the first rib 302, and the second surface 512 of the circuit board 51 is corresponding to the inner surface of the first side wall 311. Preferably, the first surface 511 of the circuit board 51 is abutted on the first rib 302, and the edge of the second surface 512 of the circuit board 51 is abutted on the inner surface of the first side wall 311 (or maintains certain space to lower the difficulty of inserting the circuit board 51 into the slot 301), so that the circuit board 51 is fixed. In actual use, the first ribs 302 are utilized in pairs, that is, the slots 301 are respectively formed at both sides of the lamp cap 3 to fix both sides of the circuit board 51. Preferably, a notch 303 is disposed on the inner surface of the first side wall 311; wherein the notch 303 is disposed extendedly along the axial direction of the lamp cap 3; wherein the notch 303 has a positioning surface 3031; wherein the positioning surface 3031 and the first rib 302 together form the slot 301 to fix the circuit board 51 better. In some embodiments, if the second member 32 is disposed at the inner side of the first member 31, the slot 301 can be disposed on the inner surface of the second member 32.

Please refer to FIG. 8, FIG. 9, FIG. 10, and FIG. 11, the instant disclosure provides an embodiment which comprises a support unit 6; wherein the support unit 6 is utilized to fix the light board 2 in the lamp tube 1; wherein the support unit 6 comprises a main body 61 and a support arm 62; wherein the support arm 62 is fixed on the main body 61 and abutted on the inner surface of the lamp tube 1, so that the support unit 6 can support the internal of lamp tube 1. The main body 61 has a first positioning portion 611; wherein the light board 2 is fixed on the first positioning portion 611; wherein utilizing the first positioning portion 611 to fix the light board 2, the structure is easy, and the craft is even easier. The support unit 6 and the lamp tube 1 are not fixed, so the support unit 6 can shift or rotate in the lamp tube 1 to further facilitate adjusting the angle of light emission of the light board 2 to determine the relative positions of the lamp cap 3 and the light board 2. The instant disclosure provides an embodiment, wherein the structure of the first positioning portion 611 comprises a positioning surface 6111; wherein the light board 2 is fixed on the positioning surface 6111 (e.g. by bonding). The instant disclosure provides an embodiment, wherein to limit the relative positions of the support unit 6 and the light board 2 in the axial direction of the lamp tube 1, the first positioning portion 611 has a positioning column 6112; wherein a positioning hole 22 is disposed corresponding to the positioning column 6112 on the light board 2. When the light board 2 and the support unit 6 are fixed, the positioning column 6112 is inserted in to the positioning hole 22, so that the relative positions of the light board 2 and the support unit 6 are fixed in the length direction of the light board 2. By the arrangement of the positioning column 6112 and the positioning hole 22, the contacting proportion of the support unit 6 and the light board 2 integrated is enlarged, so that the stability of the connection is boosted.

The instant disclosure provides an embodiment, wherein the support arm 62 is made of flexible material, for instance, plastic material in the related art. When the support unit 6 is disposed in the lamp tube 1, the support arm 62 applies force to the inner surface of the lamp tube 1 to achieve better supporting and fixing effect. The instant disclosure provides an embodiment, to facilitate the support unit 6 inserted into the internal of the lamp tube 1, the support arm 62 comprises a support portion 621 and a bending portion 622; wherein the support portion 621 is connected to the main body 61 by the bending portion 622; wherein the bending portion 622 is spaced in a range from the inner surface of the lamp tube 1 to facilitate one side of the bending portion 622 inserted into the lamp tube 1.

Furthermore, the instant disclosure provides an embodiment, wherein the first positioning portion 611 has a positioning groove 612; wherein the positioning surface 6111 is formed at the bottom of the positioning groove 612. Sidewalls 613 are disposed at both sides of the positioning groove 612; wherein the light board 2 is inserted into the positioning groove 612 to fix; wherein both sides in the width direction of the light board 2 are corresponding to the side walls 613 of both sides of the positioning groove 612, to limit the relative rotation of the support unit 6 and the light board 2.

The instant disclosure provides an embodiment, wherein the support unit 6 further comprises a second positioning portion 614; wherein the basic structure of the second positioning portion 614 is the same as the basic structure of the first positioning portion 611. That is, the second positioning portion 614 also comprises the positioning surface 6111 and the positioning groove 612. The second positioning portion 614 and the first positioning portion 611 are respectively disposed at both sides of the main body 61 of the support unit 6 to fix two sets of the light boards 2. The two sets of light boards 2 are disposed in opposite direction, so the light is emitted respectively from both sides of the lamp tube 1 to achieve the effect of double-sided light emission. The instant disclosure provides an embodiment, wherein two sets of the light boards 2 are disposed respectively in the first positioning portion 611 and the second positioning portion 612; wherein the two sets of the light boards 2 are spaced between each other, so that a part of the heat generated by the light source 21 can be radiated through the light board 2 to the air in the space between the two sets of the light boards 2 to facilitate the effect of heat dissipation.

Figure 9:
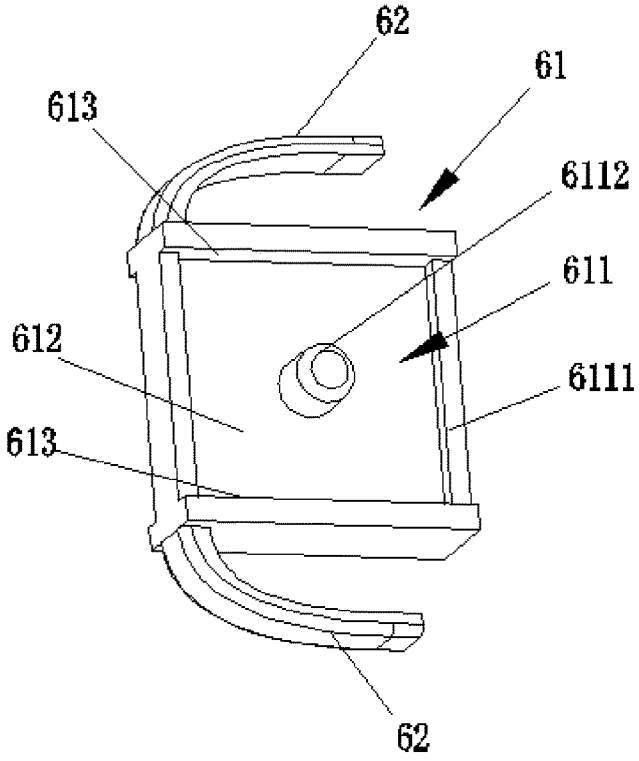
FIG. 9 illustrates a three-dimensional schematic diagram showing the support unit.
Figure 10:
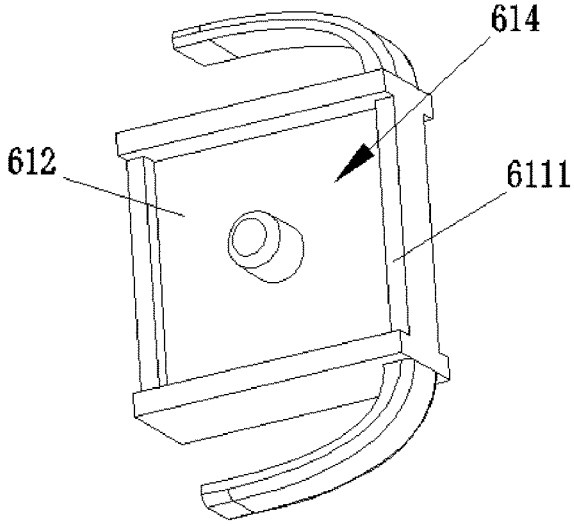
FIG. 10 illustrates a three-dimensional schematic diagram showing the support unit.
Figure 11:
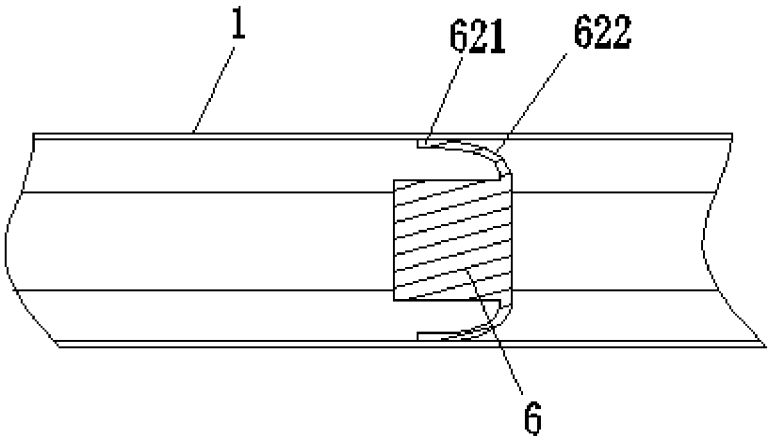
FIG. 11 illustrates schematic diagram showing the support unit and the lamp tube integrated.

Please refer to FIG. 3 and FIG. 9, the instant disclosure provides an embodiment, wherein the first positioning portion 611 and the second positioning portion 612 are disposed symmetrically in the lamp tube 1; wherein the ratio of the space a (that is, the distance between the two sets of the light boards 2) between the positioning surface 6111 of the first positioning portion 611 and the positioning surface 6111 of the second positioning portion 612 to the inner diameter r of the lamp tube 1 is between 1:2 to 1:5; Preferably, the ratio of the space a between the positioning surface 6111 of the first positioning portion 611 and the positioning surface 6111 of the second positioning portion 612 to the inner diameter r of the lamp tube 1 is between 1:2.5 to 1:4.5; more preferably, the ratio of the space a (that is, the distance between the two sets of the light boards 2) between the positioning surface 6111 of the first positioning portion 611 and the positioning surface 6111 of the second positioning portion 612 to the inner diameter r of the lamp tube 1 is between 1:3 to 1:4. Therefore, the front side of the light board 2 (the side with the light source 21) and the back side of the light board are corresponding to enough space to radiate the heat generated from the light source 21 to the air in that space.

Figure 12:
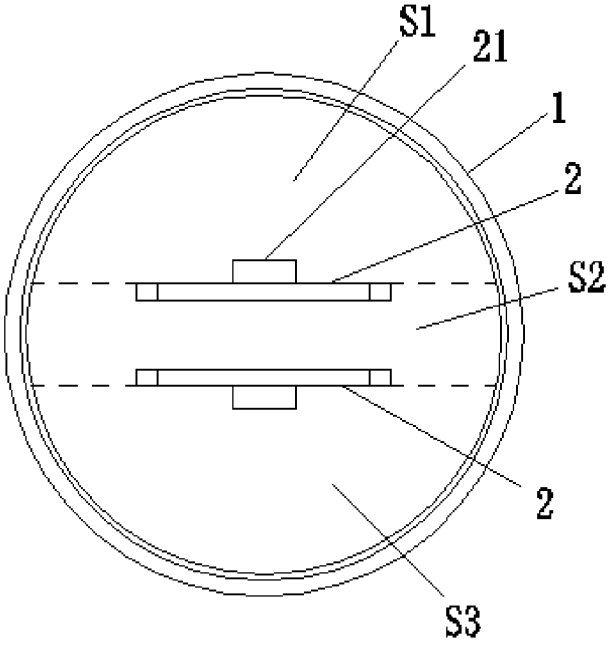
FIG. 12 illustrates schematic diagram showing the light board and the lamp tube integrated.

Please refer to FIG. 12, the instant disclosure provides an embodiment, wherein the lamp tube 1 in the radial width direction, the cross section of the lamp tube 1 is divided by two sets of the light boards 2 as a first cross section S1 (one side of the proportion of one of the light boards 2 in the lamp tube 1, one of the light sources 21 of the light boards 2 is at that side), a second cross section S2 (the proportion between two light boards 2), and a third cross section S3 (one side of the proportion of the other light board 2 in the lamp tube 1, one of the light sources 21 of the light boards 2 is at that side); wherein one side of the light board 2 with the light source 21 which requires more air to conduct convection to dissipate the heat (one part of the heat generated by the operation of the light source 21 is directly radiated to the air while the other part of the heat is conducted to the light board 2 and radiated to the air through the light board 2. That is, one side of the light board 2 with the light source 21 has more heat required to dissipate). As a result, the proportion of the first cross section S1 and the third cross section S3 are both larger than the proportion of the second cross section S2.

The instant disclosure provides an embodiment, wherein the cross-section proportion of the first cross section S1 and the cross-section proportion of the third cross section S3 are equal or average to equal; wherein the ratio of the cross-section proportion of the first cross section S1 or the cross-section proportion or the third cross section S3 to the cross-section proportion of the second cross section S2 is between 1.5:1 to 2.5:1. When the cross-section proportion of the cross-section S2 is smaller, the space between the light board 2 and the cross-section axis of the lamp tube 1 is shorter; wherein when the light source 21 emits light through the lamp tube 1, the angle of light emission is greater; the back side of the light board 2 (the surface without the light source 21) is equipped with less heat dissipation capability. On the contrary, when the cross-section proportion of the cross section S2 is larger, the space between the light board 2 and the cross-section axis of the lamp tube 1 is shorter; wherein when the light source 21 emits light through the lamp tube 1, the angle of light emission is smaller; the back side of the light board 2 is equipped with more heat dissipation capability. By arranging the ratio of the cross-section proportion of the first cross section S1 to cross-section proportion of the second cross section S2 between 1.5:1 to 2.5:1, on one hand, the light source 21 has a larger angle of light emission; on the other hand, the effect of heat dissipation of the light source 21 is guaranteed.

The instant disclosure provides an embodiment, wherein the light board 2 is made of hard substrate, such as aluminum substrate or FR4 substrate. The instant disclosure provides an embodiment, wherein a plurality of support units 6 can be arranged in the length direction of the light board 2 to provide enough support. For instance, arranging a support unit 6 in the length direction of the light board 2 every 200 mm-250 mm in range. Considering of the hardness of the light board 2, if the space between the support units 6 is too long, the light board 2 between the two sets of the support units 6 can slightly bend over and affect the effect of light emission. The instant disclosure provides an embodiment, wherein the length of the light board 2 is between 500 mm-550 mm and the quantity of the support units 6 is arranged as three sets.

Figure 13:
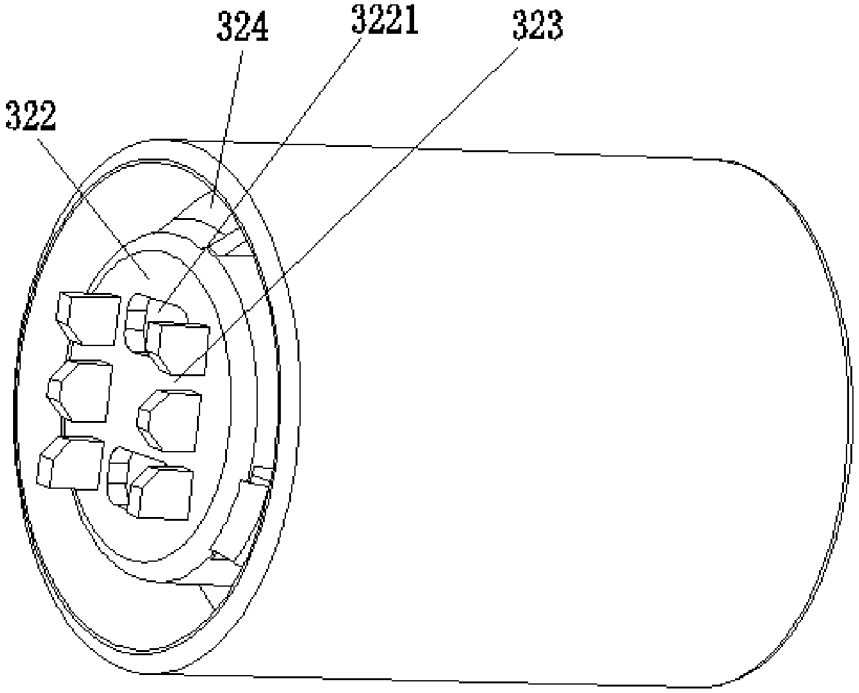
FIG. 13 illustrates a three-dimensional schematic diagram showing the second member.

Please refer to FIG. 3 and FIG. 13, the instant disclosure provides an embodiment, wherein the light board 2 is fixed in the lamp tube 1 by the support unit 6, and compared to the lamp tube structure emitting light in one direction and stick the light board 2 directly into the inner wall of the lamp tube 1, the position of the light board 2 in the lamp tube 1 is not fixed, thus the second member 32 disposes a stop surface 322 at one side close to the light board 2 which limit the position of the light board 2 in the length direction of the lamp tube 1. Also, a slot 323 is disposed on the stop surface 322, wherein the end portion of the light board 2 is inserted into the slot 323 to fix, in order to limit the rotation of the light board 2 in the lamp tube 1. A hole 3221 is disposed on the stop surface 322 for wire passing through (not shown), so that the wire can connect the light board 2 and the circuit board 51 respectively to complete the electrical connection.

Figure 14:
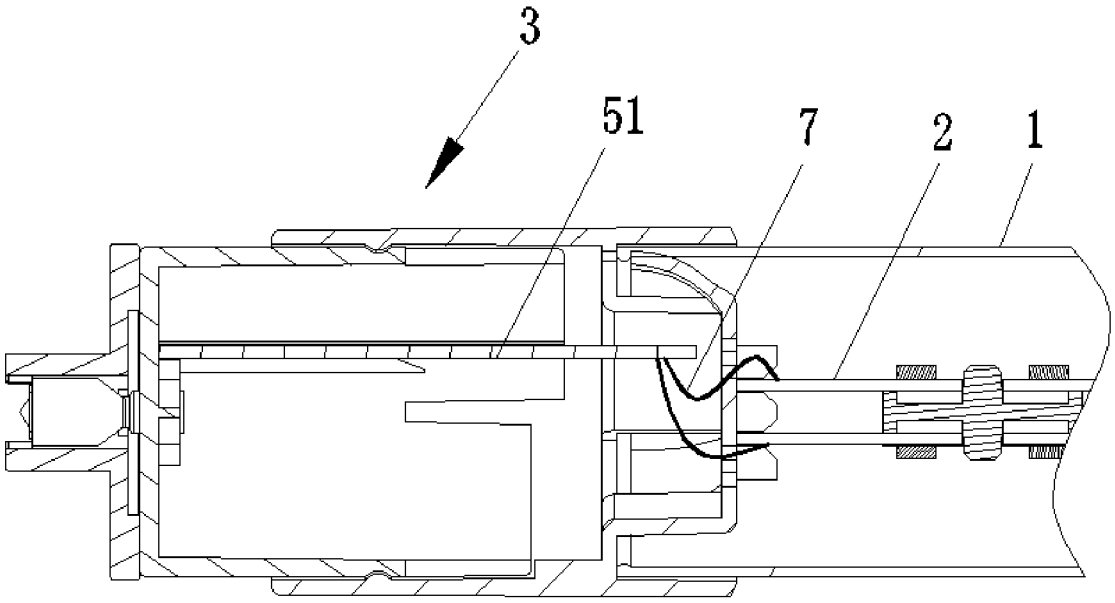
FIG. 14 illustrates schematic diagram showing the circuit board and the light board connected according to an embodiment of the instant disclosure.
Figure 15:
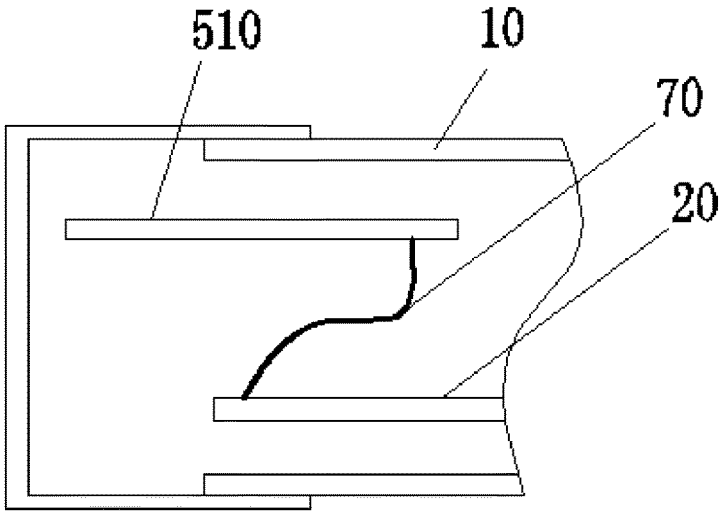
FIG. 15 illustrates schematic diagram showing the circuit board and the light board connected in related art.

Please refer to FIG. 14, the instant disclosure provides an embodiment, wherein the projection of the circuit board 51 and the lamp tube 1 is not overlapped in the opposite radial direction of the lamp tube 1; that is, the circuit board 51 and the light board 2 maintain space in the axial direction of the lamp tube 1, thus when the circuit board 51 and the light board 2 are connected by a wire 7, the length of the wire 7 is required shorter; wherein integrating the lamp cap 3 and the lamp tube 1, the inlet space of the circuit board 51 is shorter (the space of circuit board 51 inserted into the lamp tube 1), there is no need to bend the wire 7 substantially, so the wire 7 is not easily dragged to cause the disconnection between the wire 7 and the circuit board 51 or the light board 2. As a comparison, FIG. 15 shows a circuit board 510 and a light board 20 integrated in related art; wherein the projection of the circuit board 510 and the light board 20 is overlapped in the radial direction of a lamp tube 10; that is, the circuit board 510 and the light board 20 are interleaved in the axial direction of the lamp tube 10, thus, in installation, the inlet space of the circuit board 510 is longer (the space of the circuit board 510 inserted into the lamp tube 10) which requires a longer wire 70, besides, when inserted into the tube, the wire 70 is required to bend over substantially, so that the wire 70 could affect other electronic components; also when inserted into the tube, the wire 70 is easily dragged and the disconnection between the wire 70 and the circuit board 510 or the light board 20 may occur.

Please refer to FIG. 3 and FIG. 13, the instant disclosure provides an embodiment, wherein when the lamp tube 1 and the second member 32 are connected, an abutting arm 324 is disposed on the second member 32; wherein the abutting arm 324 is extendedly disposed in the direction away from the light board 2; wherein an abutting portion 3241 is disposed at the end portion of the abutting arm 324. A positioning convex portion 11 is disposed on the inner surface of the end portion of the lamp tube 1; wherein the abutting portion 3241 of the abutting arm 324 correspondingly matches with the positioning convex portion 11 in the axial direction of the lamp tube 1. When the second member 32 is inserted into the lamp tube 1, the abutting portion 3241 matches with the positioning convex portion 11, to prevent the detachment of the second member 32 and the lamp tube 1 in the axial direction. The instant disclosure provides an embodiment, wherein the abutting arm 324 is made of flexible material (e.g., plastic) to facilitate the abutting arm 324 inserted into the lamp tube 1.

The instant disclosure provides an embodiment, in normal state, (the second member 32 is not yet inserted into the lamp tube 1), the space of the axial line from the abutting portion 3241 to the second member 32 is longer than the inner diameter of the lamp tube 1, so that after the second member 32 is inserted into the lamp tube 1, the abutting portion 3241 applies force to the inner surface of the lamp tube 1 to maintain the position between the second member 32 and the lamp tube 1 in the radial direction.

The instant disclosure provides an embodiment, wherein the light source 21 comprises a plurality of LED lamp beads 211 (abbreviated as lamp beads in the following). To adjust the angle of light emission of the LED tube lamp, an optical unit can be disposed on the lamp beads 211; wherein the design of the optical unit comprises different states with lamp beads contact or without lamp beads contact; wherein the optical unit comprises a lens, a light shield and a reflector or a random combination of three of the above.

Figure 16:
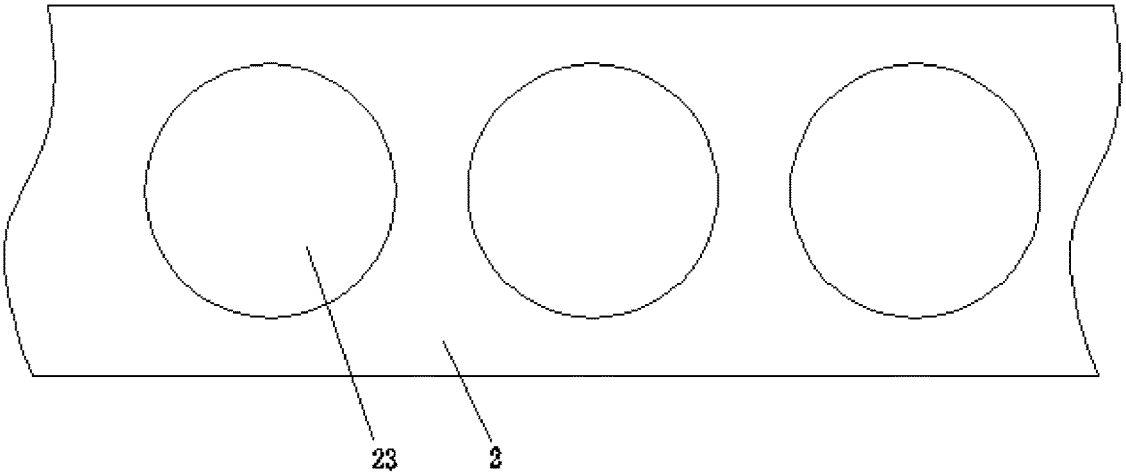
FIG. 16 illustrates schematic diagram showing the lens disposed in the light board.
Figure 17:
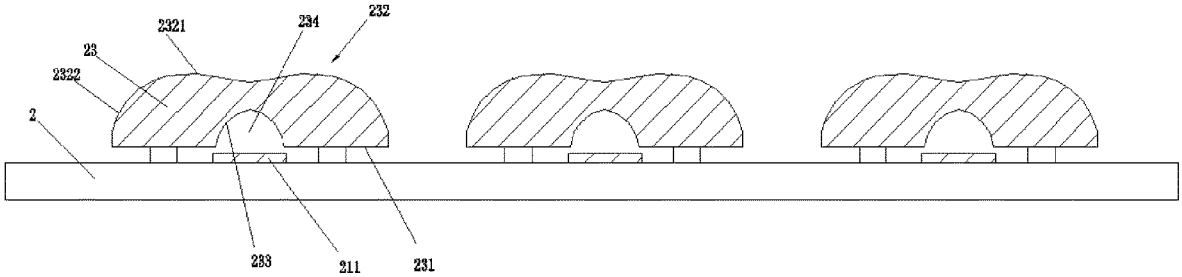
FIG. 17 illustrates a cross section diagram of FIG. 16.

Please refer to FIG. 16 and FIG. 17, in some embodiments, it comprises a lens 23; wherein the lens 23 comprises a bottom 231, an emitting portion 232 and an injecting portion 233; wherein the bottom 231 is disposed on the light board 2 in forms of contacting or not contacting to face the surface of the light board 2. The injecting portion 233 is concavely disposed at the bottom 231 and corresponding to the lamp beads 211; that is, the injecting portion 233 faces the lamp beads 211; wherein the injecting portion 233 is concavely disposed at bottom 231 which forms a cavity 234 corresponding to the lamp beads 211. Furthermore, the projection of the lamp beads 211 in the width direction of the light board 2 and the cavity 234 is not overlapped to achieve better effect of light emission. In some embodiments, at least partial of the lamp beads 211 is mounted inside the cavity 234; that is, the projection of the lamp beads 211 in the width direction of the light board 2 and cavity 234 is overlapped to control the height of the entire structure, the height of the entire structure after the lens 23 is disposed on the light board 2.

Please refer to FIG. 16, the instant disclosure provides an embodiment, wherein the optical unit comprises a lens 23; wherein one optical unit is corresponding to one lamp bead 211 respectively. In some embodiments, the optical unit comprises a plurality of lens 23 (not shown); wherein one optical unit is corresponding to a plurality of lamp beads 211; wherein when the optical unit is installed, a plurality of lens 23 are arranged on the lamp beads 211 to simplify the craft of installation of the optical unit and boost production efficiency.

Please refer to FIG. 17, the instant disclosure provides an embodiment, wherein the emitting portion 232 comprises a top emitting surface 2321 and a side emitting surface 2322; wherein the side emitting surface 2322 is circled around the top emitting surface 2321; wherein the top emitting surface 2321 and the side emitting surface 2322 can be equipped with different degrees of curvature.

Please refer to FIG. 16 and FIG. 17, the instant disclosure provides an embodiment, wherein the emitting portion 232, as a whole, is rotary body structure; that is, the cross section of the emitting portion 232 along the width direction of the light board 2 is a circle, so that when the lamp beads 211 emits light, the effect of light emission around the emitting portion 232 is more even.

Figure 18:
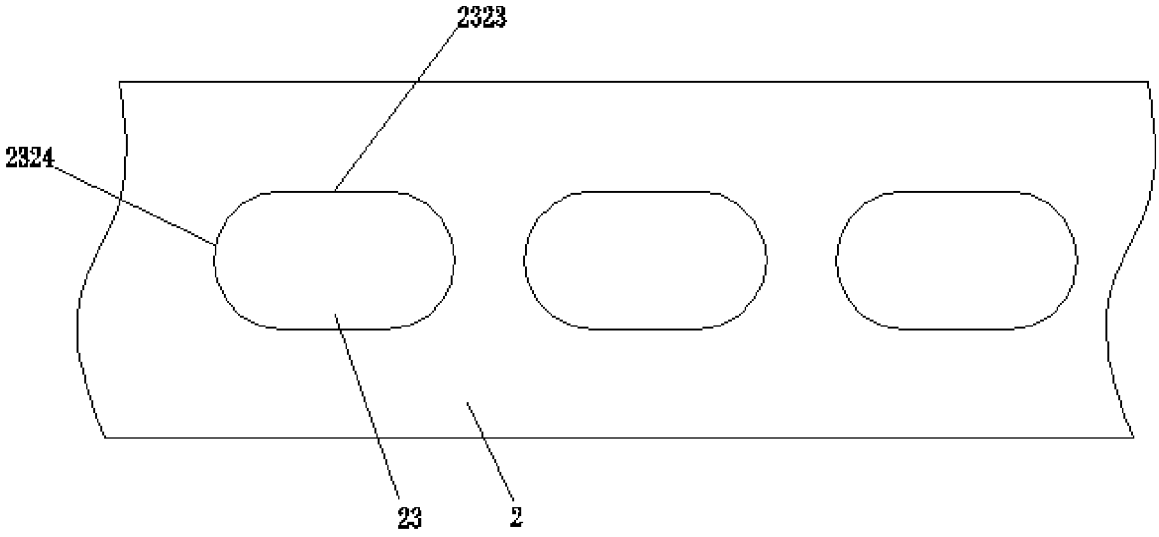
FIG. 18 illustrates schematic diagram showing the lens and the light board integrated in some embodiments.
Figure 19:
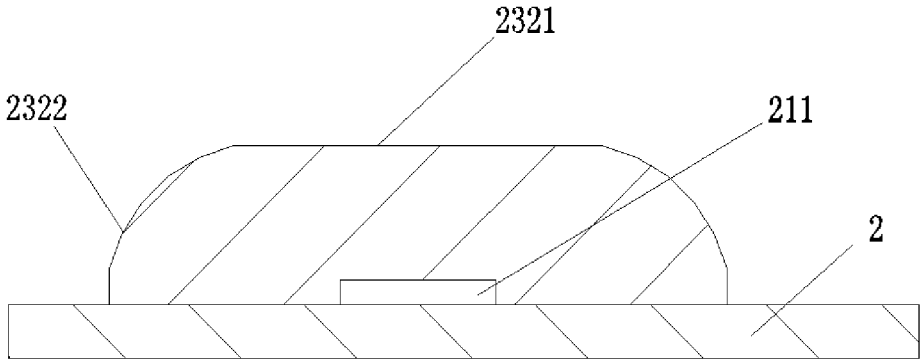
FIG. 19 illustrates a partially cross section of FIG. 18.
Figure 20:
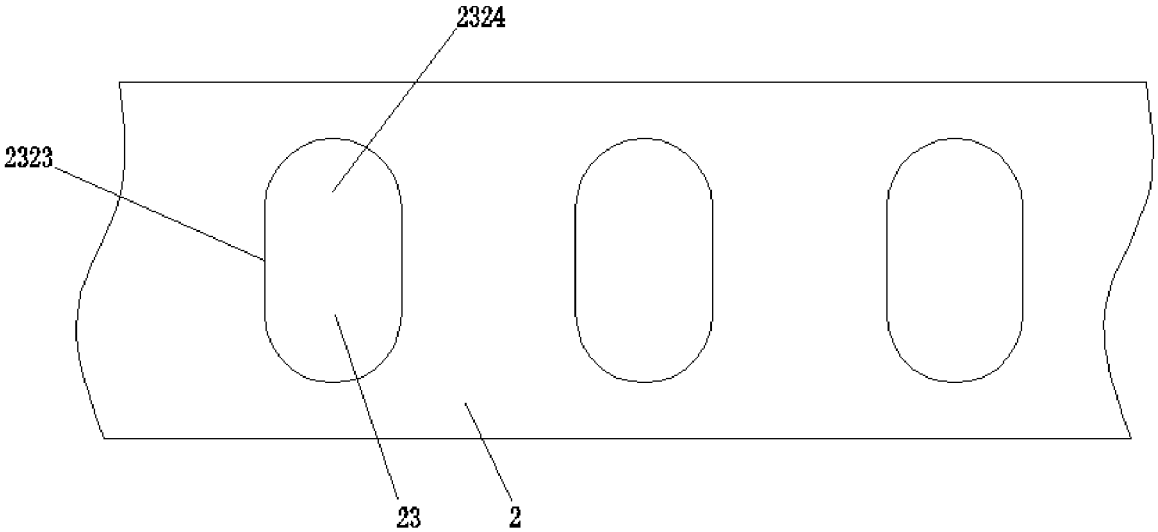
FIG. 20 illustrates schematic diagram showing the arrangement of the lens.
Figure 21:
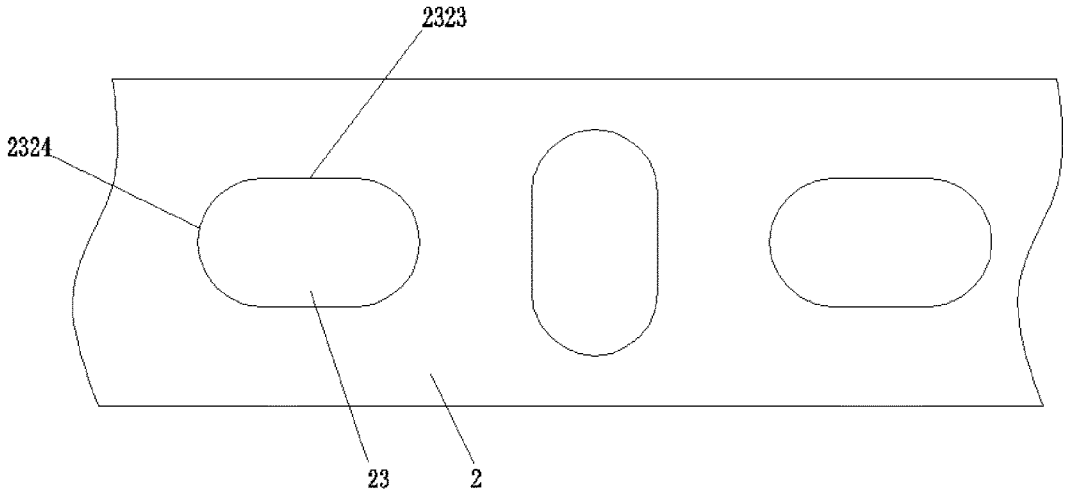
FIG. 21 illustrates schematic diagram showing the arrangement of the lens.

Please refer to FIG. 18 and FIG. 19, in some embodiments, the top emitting surface 2321 comprises a length direction and a width direction; wherein the side emitting surface 2322 comprises a first side emitting surface 2323 and a second side emitting surface 2324; wherein the first side emitting surface 2323 is disposed on the side in the length direction of the top emitting surface 2321 while the second side emitting surface 2324 is disposed on the side in the width direction of the top emitting surface 2321. When implementing the embodiment, as shown in FIG. 18, the length direction of the top emitting surface 2321 can be disposed along the length direction of the light board 2 to raise the angle of light emission along the length direction of the LED tube lamp. As shown in FIG. 20, the width direction of the top emitting surface 2321 can be disposed along the length direction of the light board 2 to raise the angle of light emission along the width direction of the LED tube lamp. As shown in FIG. 21, the aforementioned two arrangements can also be interleavedly disposed to enlarge the angle of light emission of the LED tube lamp in both the length direction and the width direction. Specifically, a lens 23 in the length direction of the top emitting surface 2321 can be disposed along the length direction of the light board 2 while the adjacent lens 23 in the width direction of the top emitting surface 2321 can be disposed along in the length direction of the light board 2.

Figure 22:
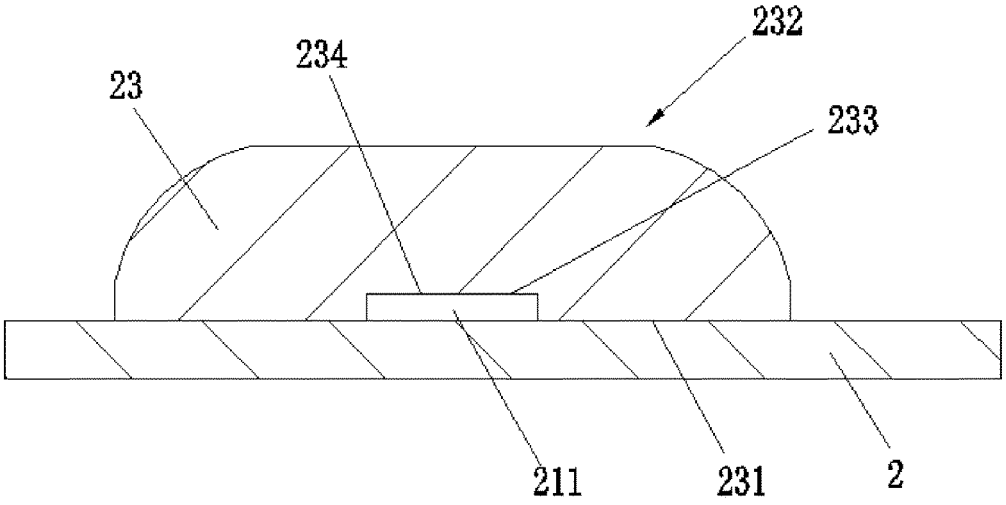
FIG. 22 illustrates schematic diagram showing the lens and the light board integrated in one embodiment.

Please refer to FIG. 22, in another embodiment, which comprises a lens 23; wherein the basic structure of the lens 23 is the same as the basic structure of the lens of the above embodiment. Specifically, the instant disclosure provides an embodiment, wherein the lens 23 comprises a bottom 231, an emitting portion 232 and an injecting portion 233; wherein the bottom 231 is disposed on the light board 2 in form of contacting to face the surface of the light board 2; wherein the specific bottom 231 is directly bonded to the surface of the light board 2. The instant disclosure provides an embodiment, wherein the bottom 231 can be bonded to the surface of the light board 2 by glue or by the stickiness of the bottom 231. The injecting portion 233 is concavely disposed at the bottom 231 and corresponding to the lamp beads 211; wherein the injecting portion 233 faces the lamp beads 211; wherein when the injecting portion 233 is concavely disposed at the bottom 231, a cavity 234 is formed, and the lamp beads 211 are corresponding to the cavity 234. Furthermore, at least partial of the lamp beads 211 is mounted inside the cavity 234; that is, the projection of the lamp beads 211 in the width direction of the light board 2 and the cavity 234 is overlapped to control the height of the entire structure, the height of the entire structure after the lens 23 disposed on the light board 2. The instant disclosure provides an embodiment, wherein the cavity 234 integrates with the surface of the lamp beads 211; that is, there is no slit between the cavity 234 and the surface of the lamp beads 211.

Figure 23:
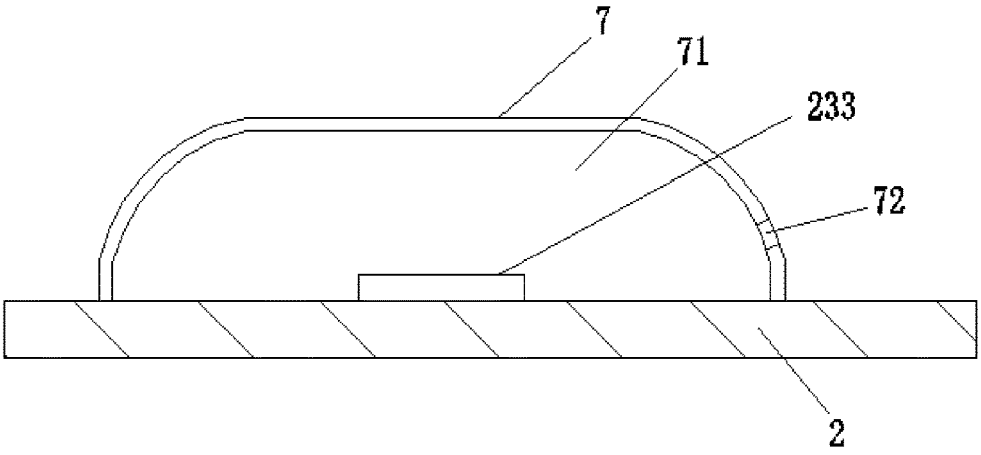
FIG. 23 illustrates schematic diagram showing the mold and the light board integrated.

The instant disclosure provides an embodiment, wherein the lens 23 is made of silicon, and is directly formed on the light board 2. Specifically, as shown in FIG. 23, the injection molding is achieved by using a mold 7, as shown in FIG. 23, the mold 7 has a mold cavity 71; wherein the shape of the mold cavity 71 is the shape of the lens 23, by arranging an injection hole 72 on the mold 7, bonding the mold 7 on the light board 2, and matching the mold cavity 71 with the lamp beads 211, the silicon is injected into the mold cavity 71 through the injection hole 72, after the solidification of the silicon, take off the mold 7 to complete the injection molding.

In one embodiment, it comprises an LED tube lamp, wherein the basic structure of the LED tube lamp is the same as the basic structure of the LED tube lamp in FIG. 1, and both in order to achieve double-sided light emission, both comprise a lamp tube 1 and two sets of light boards 2. The difference from the previous embodiment is between the two sets of the light boards 2, different arrangements are adopted, and the instant disclosure provides an embodiment, wherein the light board 2 is not required to connect with a corresponding lamp cap; however, the structure of rotation of the lamp cap in the previous embodiment can be adopted in this embodiment (that is, the lamp cap 3 comprises the first member 31, the second member 32 and the connecting structure 33).

Figure 24:
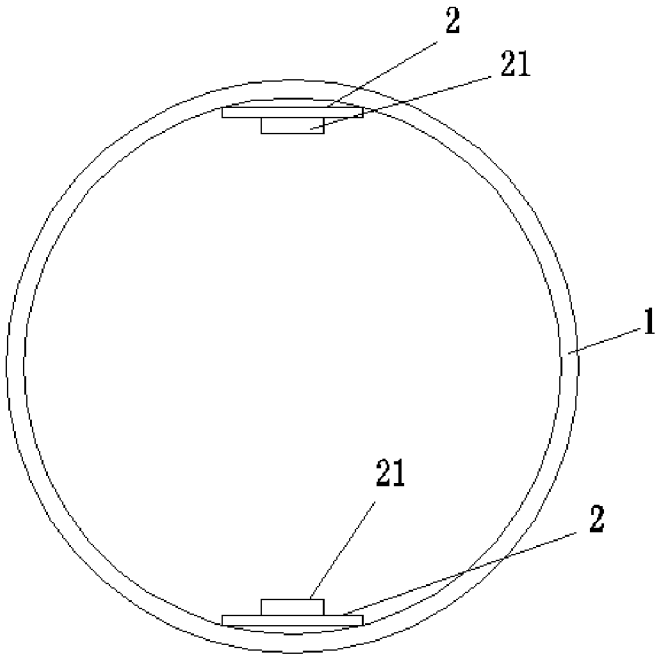
FIG. 24 illustrates a cross section diagram of an LED tube lamp according to an embodiment of the instant disclosure.

Specifically, as shown in FIG. 24, two sets of the light boards 2 are disposed opposite to the lamp tube 1 in order to dispose the light source 21 of the two sets of the light boards 2. The instant disclosure provides an embodiment, wherein two sets of the light boards 2 are respectively bonded to the inner surface of the lamp tube 1 by glue (not shown) to form a heat conduction path among the light source 21, the light board 2, and the lamp tube 1. Specifically, when the LED tube lamp is operating, the heat generated by the light source 21 is conducted to the light board 2 in form of heat conduction, and conducted from the light board 2 to the lamp tube 1 in form of heat conduction, and to further dissipate the heat by the lamp tube 1 with a larger surface proportion to achieve better effect of heat dissipation.

To better explain the embodiment, please refer to FIG. 25 to FIG. 29, there are two lines on a light source (a first light source 2101 and a second light source 2102) representing the angle of light emission of the light source (the first light source 2101 and the second light source 2102) in the width direction of the lamp tube 1 (usually the angle of light emission of an LED is around 120 degrees).

Figure 25:
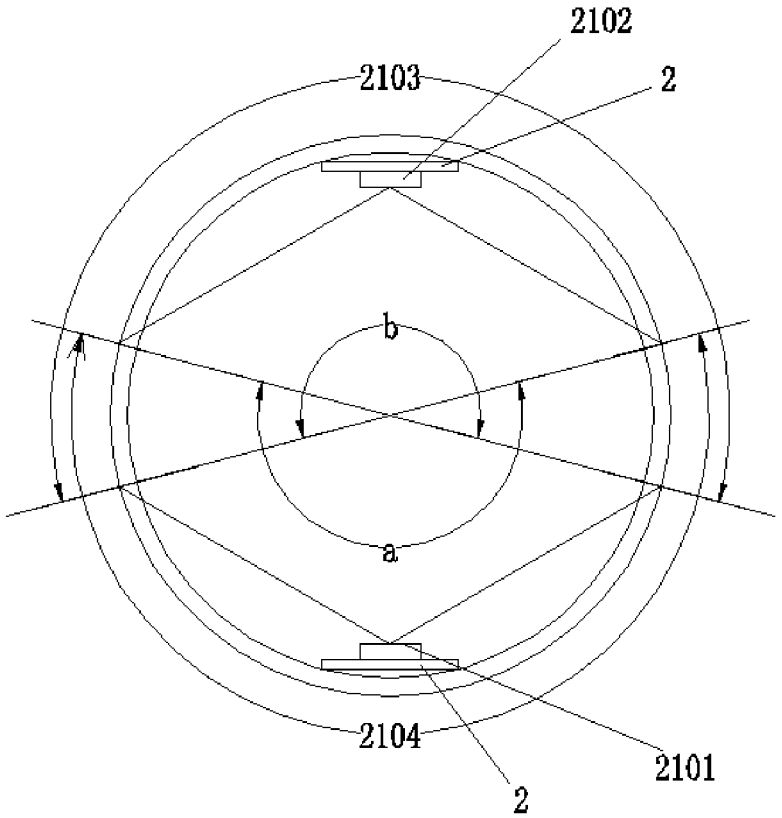
FIG. 25 illustrates schematic diagram showing the light distribution on the lamp tube in FIG. 24.

Please refer to FIG. 25, from the view of the angle of light emission of the LED tube lamp, when two sets of the light sources 21 are disposed opposite to each other, that is, the first light source 2101 and the second light source 2102 are disposed opposite to each other, in the width direction of the lamp tube 1 (the cross section of the lamp tube in the radial direction), when the first light source 2101 and the second light source 2102 are emitting, a first light-emitting zone 2103 and a second light-emitting zone 2104 (considering without the block factor of the light board 2) are respectively formed on the lamp tube 1 (in the width direction of the light board 2), the first light-emitting zone 2103 corresponding to the cross section of the lamp tube 1 is a central angle a; the second light-emitting zone 2104 corresponding to the cross section of the lamp tube 1 is a central angle b. To meet the end of 360 degrees light emission (ignoring the block of the light board 2) in the width direction of the lamp tube 1, the sum of central angle a of the first light-emitting zone 2103 corresponding to the cross section of the lamp tube 1 and the central angle b of the second light-emitting zone 2104 corresponding to the cross section of the lamp tube 1 is larger than or equal to 360 degrees. The instant disclosure provides an embodiment, wherein the first light-emitting zone 2103 and the second light-emitting zone 2104 is referring to a light-emitting zone configured on the lamp tube 1 (the light is directly emitted by the light source, not including a reflective surface, a diffusion film, and etc., reflected or refracted by an optical unit) when the LED tube lamp is operating.

Figure 26:
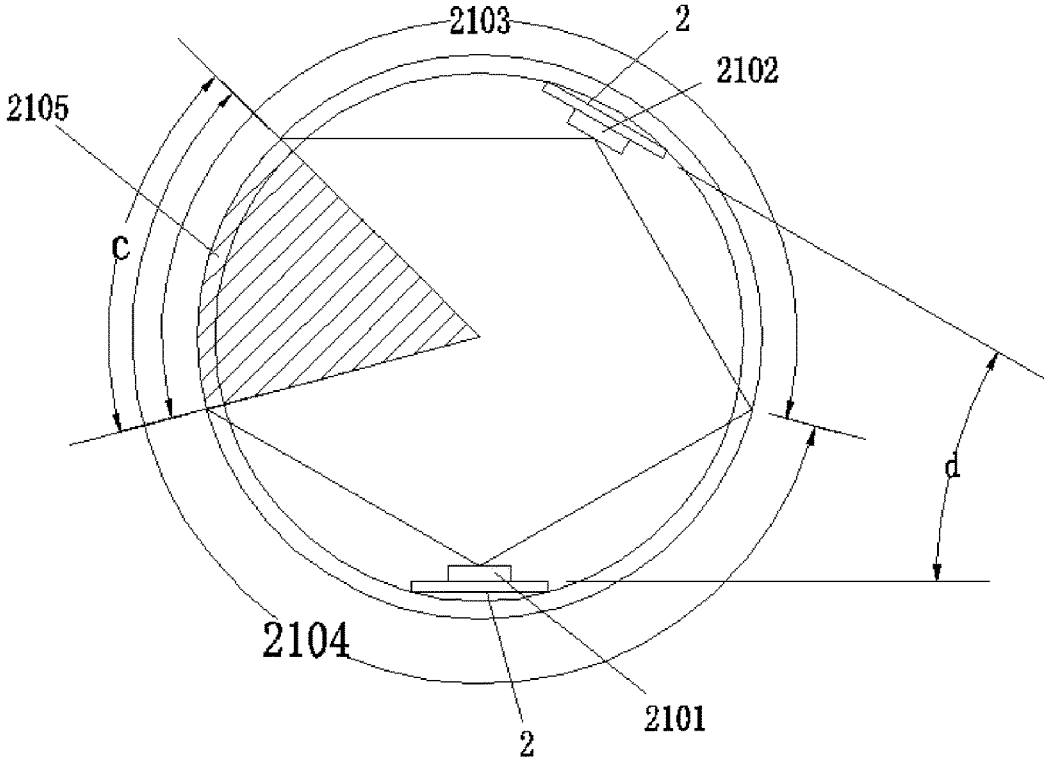
FIG. 26 illustrates a cross section diagram of an LED tube lamp in some embodiments.

Please refer to FIG. 26, in some embodiments, the first light-emitting zone 2103 and the second light-emitting zone 2104 have an overlapping zone 2105 (e.g., the part of the cross-section lined in FIG. 26), the overlapping zone 2105 corresponding to the cross section of the lamp tube 1 is central angle c. To meet the end of 360 degrees light emission (ignoring the block of the light board 2) in the width direction of the lamp tube 1, the relationship among the central angle a, the central angle b and the central angle c need to meet the requirement as the following: a+b– c≥360°. Please refer to FIG. 27, in a particular embodiment, the overlapping zone 2105 is arranged discontinuously on the cross section of the lamp tube 1, which requires to calculate the sum of the central angles of all overlapping zones 2105 corresponding to the cross section of the lamp tube 1.

Figure 27:
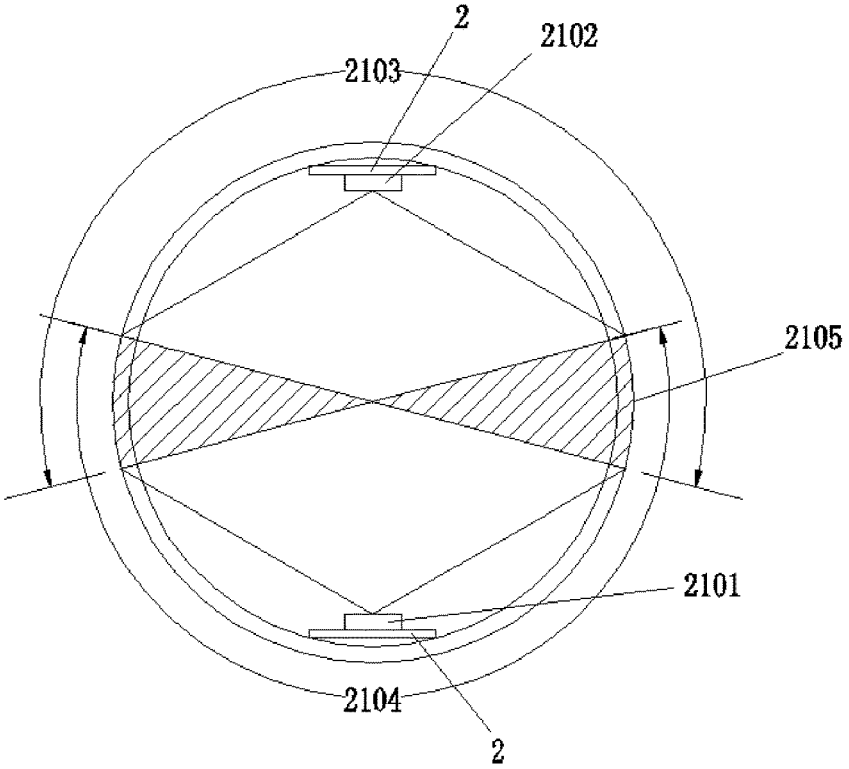
FIG. 27 illustrates a cross section diagram of an LED tube lamp according to a particular embodiment.
Figure 30:
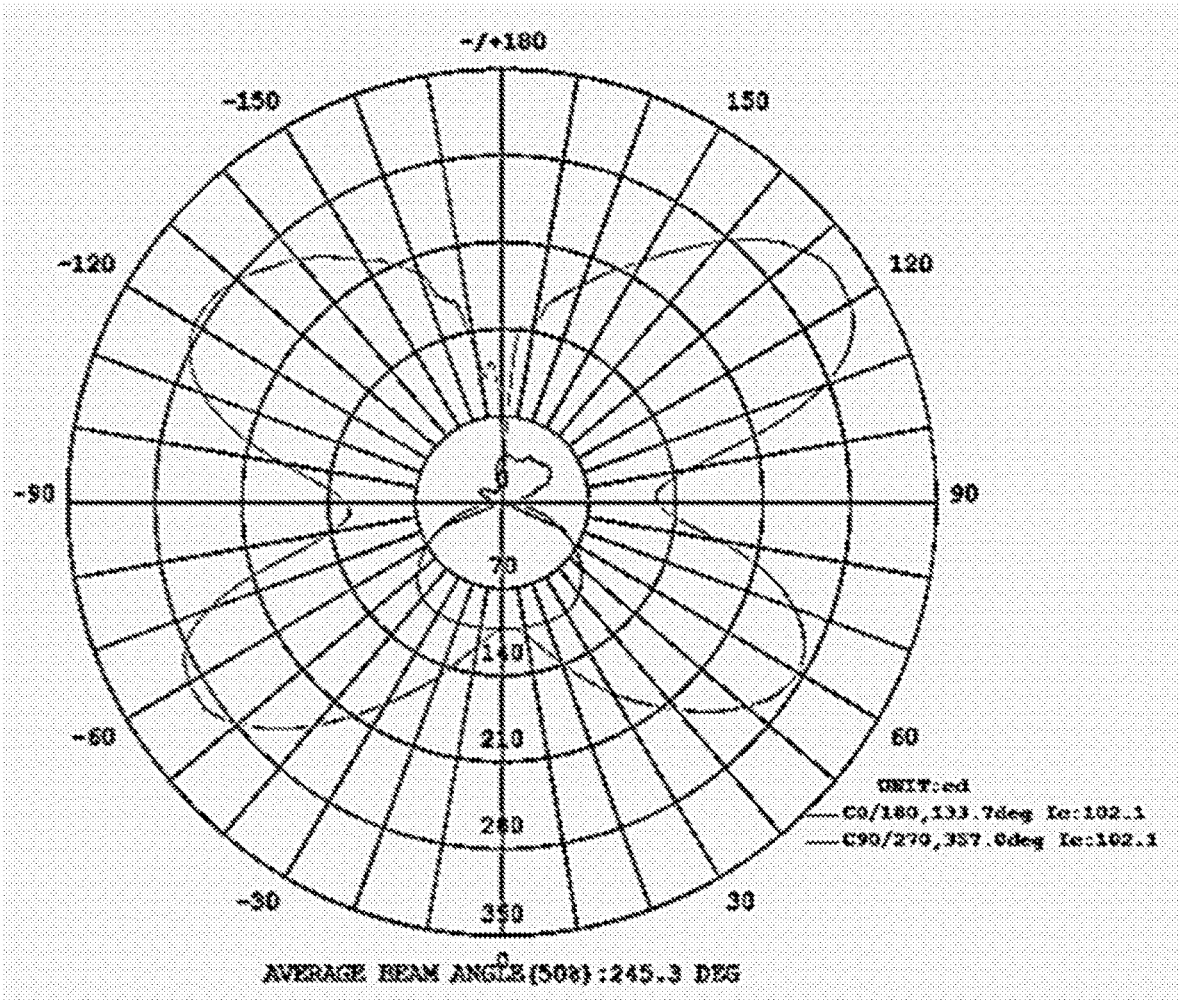
FIG. 30 illustrates schematic diagram showing the light distribution of an LED tube lamp in FIG. 27.

Please refer to FIG. 27, in a particular embodiment, two sets of the light boards 2 are disposed parallelly or average to parallelly (that is, there is no nip angle between two sets of the light boards 2), so that the first light source 2101 and the second light source 2102 corresponding to the first light-emitting zone 2103 and the second light-emitting zone 2104 are in symmetrical arrangement (in the condition of adopting the same light source). By this way, the lamp tube 1 (in the width direction) receives a more even light emission. FIG. 30 illustrates two sets of the light boards 2 disposed as in FIG. 27 the measurement of a light distribution diagram. As shown in FIG. 30, from view of the light distribution, the arrangement of the light boards 2 in FIG. 27 achieves a greater angle of light emission.

Please refer to FIG. 26, in some embodiments, a nip angled is formed between two sets of the light boards 2 (a nip angle d is formed between the plane extension line of the two sets of the light boards 2); wherein the nip angle d is an acute angle. Specifically, the angle of the nip angle d is smaller than half of nip angle c. For instance, when the angle of light emission of the LED is around 120 degrees, the nip angled is less than 40 degrees; preferably the nip angle d is less than 30 degrees; more preferably the nip angle d is less than 10 degrees, so that both sides of the lamp tube 1 receive different angles of light emission to meet operations according to different requirements.

In some embodiments, to minimize the block of light emission from the light source opposite to the light board 2, the angle of the central angle e of the light board 2 corresponding in the width direction of the lamp tube 1 is arranged less than 40 degrees; preferably the central angle e is less than 35 degrees. That is, the light-emitting zone in the width direction of the lamp tube 1 takes the central angle more than 280 degrees in the width direction of the lamp tube 1. Besides, the light source 21 is not disposed in center of a circle, thus, practically, the lamp tube 1 has a greater angle of light emission compared to an angle of light emission of 280 degrees. For instance, the light sources 21 of the two sets of the light boards 2 are parallelly disposed, and the angle of light emission from one side of the lamp tube 1 is more than 150 degrees.

Figure 28:
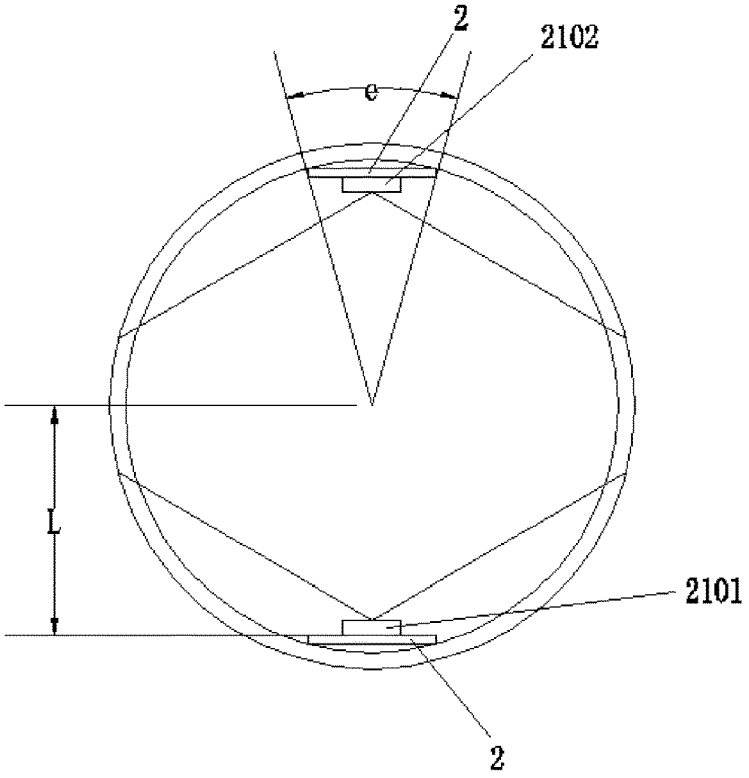
FIG. 28 illustrates a cross section diagram of an LED tube lamp in some embodiments.

Also, to minimize the block of light emission from the light source opposite to the light board 2, the space between the light board 2 and the lamp tube 1 is shortened; in other words, the distance L from the light board 2 to the center of the circle of the lamp tube 1 is further elongated. Specifically, as shown in FIG. 28, the ratio of the space L from the light board 2 to the center of the circle of the lamp tube 1 to the inner diameter of the lamp tube is greater than 0.85; preferably, the ratio of the space L from the light board 2 to the center of the circle of the lamp tube 1 to the inner diameter of the lamp tube is greater than 0.9; more preferably, the ratio of the space L from the light board 2 to the center of the circle of the lamp tube 1 to the inner diameter of the lamp tube is greater than 0.93, so the block of light emission from the opposite light source is minimized effectively.

Figure 31:
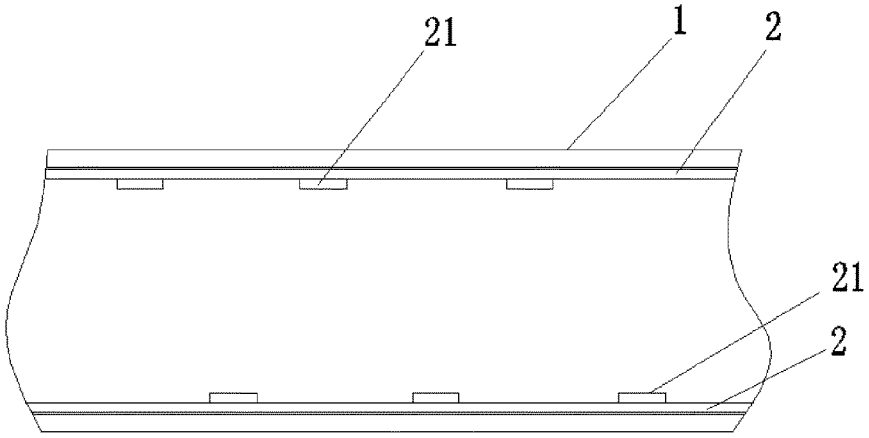
FIG. 31 illustrates a partial schematic diagram of an LED tube lamp according to an embodiment of the instant disclosure.

Please refer to FIG. 31, in some embodiments, when two sets of the light boards 2 are disposed opposite to each other, the light source 21 on the two sets of the light boards 2 (e.g. the lamp beads) in the axial direction of the LED tube lamp is interleaved. Therefore, the effect of light emission in the length direction of the lamp tube 1 is more even.

Figure 29:
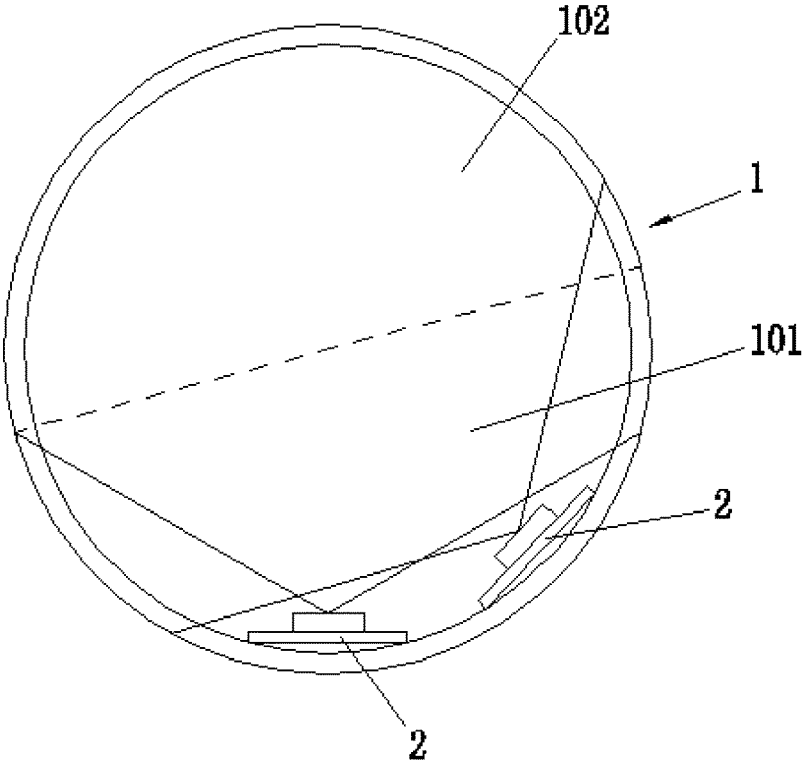
FIG. 29 illustrates a cross section diagram of an LED tube lamp in some embodiments.

Please refer to FIG. 29, in some embodiments, to enlarge the angle of light emission of the lamp tube 1, the two sets of the light boards 2 are disposed on the same side in the width direction of the lamp tube 1; that is, the inner portion in the width direction of the lamp tube 1 is comprised of two equal components, for instance, a first component 101 and a second component 102, wherein the two sets of the light boards 2 are disposed in the first component 101 or the second component 102 simultaneously. Also, the two sets of the light boards 2 are not overlapped in the width direction of the lamp tube 1; by the arrangement, on one hand, the angle of light emission of the lamp tube 1 is enlarged; on the other hand, the light-emitting intensity of the partial of the lamp tube 1 is boosted. Preferably, the instant disclosure provides an embodiment, wherein the nip angle between the two sets of the light boards 2 is larger than 90 degrees.

In some embodiments, the light board 2 can employ a flexible substrate (an FPC substrate) or a hard substrate (e.g., an aluminum substrate, a FR4 substrate).

While the embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention. The disclosure of all articles and references, including patent applications and publications, is hereby incorporated by reference for all purposes. The omission of any aspect of the subject matter disclosed herein in the preceding claims is not intended to abandon the subject matter, nor should the inventor be considered to have considered the subject matter as part of the disclosed subject matter.

What is claimed is:

1. An LED tube lamp, comprising:

a lamp tube;

two light boards, disposed in the lamp tube, having a plurality of light sources mounted thereon;

two lamp caps, respectively disposed at both ends of the lamp tube and having a power supply disposed therein, the power supply comprises a circuit board; and a support unit being an independent piece;

wherein the support unit is configured to fix the light board and comprises a main body and an elastic arm;

wherein the main body is a rectangular board, the elastic arm curvedly extends from a corner of the main body toward another corner of the main body, and the elastic arm rests on an inner surface of the lamp tube, so that the support unit is elastically supported by the inner surface of the lamp tube.

2. The LED tube lamp of claim 1, wherein the main body comprises a first fixed portion, and the light board is disposed on the first fixed portion.

3. The LED tube lamp of claim 2, wherein the support unit comprises a second fixed portion, and there are two sets of the light boards respectively disposed on the first fixed portion and the second fixed portion.

4. The LED tube lamp of claim 1, wherein the ratio of the space between the two sets light boards to the space of the inner diameter of the lamp tube is between 1:2 and 1:5.

5. The LED tube lamp of claim 1, wherein the cross section of the lamp tube is divided by the two sets light boards as a first cross section, a second cross section and a third cross section; wherein the proportion of the first cross section and the third cross section is larger than the proportion of the second cross section.

6. The LED tube lamp of claim 5, wherein the ratio of the cross-section proportion of the first cross section to cross-section proportion of the second cross section is between 1.5:1 and 2.5:1.

7. The LED tube lamp of claim 1, wherein the lamp cap comprises a first member, a second member and a connecting structure; wherein the first member and the second member are connected to each other through the connecting structure; wherein the first member comprises a first side wall and an end wall; wherein a hollow conductive pin is disposed on the end wall; wherein the second member comprises a second side wall; wherein the first side wall and the second side wall are disposed coaxially and connected rotatably.

8. The LED tube lamp of claim 7, wherein the connecting structure comprises a guiding convex portion and a guiding notch; wherein one of the guiding convex portion and the guiding notch is disposed on the first member while the other is disposed on the second member; wherein the guiding convex portion and the guiding notch are disposed extendedly in the circumferential direction of the lamp cap; wherein the guiding convex portion and the guiding notch are integrated with each other, so that the guiding convex portion can rotate along the guiding notch.

9. The LED tube lamp of claim 8, wherein a plurality of first slots are disposed at one end in an axial direction of the first side wall of the first member; wherein the plurality of first slots are disposed in the circumferential direction of the first side wall.

10. The LED tube lamp of claim 8, wherein the first slot is configured in an inner surface of the first member; wherein the circuit board is inserted into the first slot to fix.

11. The LED tube lamp of claim 7, wherein the second member is provided with a stop surface, a second slot is disposed on the stop surface, wherein an end portion of the light board is inserted into the second slot.

12. The LED tube lamp of claim 1, wherein one side of the main body is provided with a first positioning portion, an opposite side of the main body is provided with a second positioning portion, and each of the two light boards is attached on one of the first positioning portion and the second positioning portion.

13. The LED tube lamp of claim 12, wherein each of the first positioning portion and the second positioning portion has a positioning column, and a positioning hole is disposed in the light board for being inserted by the positioning column.

14. The LED tube lamp of claim 12, wherein each of the first positioning portion and the second positioning portion comprises a positioning surface, the first positioning portion has a positioning recess, the positioning surface is formed at a bottom of the positioning recess, two sidewalls are formed at both opposite sides of the positioning recess, and one of the light boards is embedded into the positioning recess and clamped by the sidewalls.

15. The LED tube lamp of claim 1, wherein the support unit is rotatable in the lamp tube.

* * * * *